US007322772B2

(12) United States Patent
Shaw et al.

(10) Patent No.: US 7,322,772 B2
(45) Date of Patent: Jan. 29, 2008

(54) SURFACE SEEDED FINE AGGREGATE CONCRETE SIMULATING QUARRIED STONE

(75) Inventors: Ronald D. Shaw, Corona Del Mar, CA (US); Lee A. Shaw, Newport Beach, CA (US)

(73) Assignee: Lithocrete, Inc., Costa Mesa, CA (US)

( * ) Notice: Subject to any disclaimer, the term of this patent is extended or adjusted under 35 U.S.C. 154(b) by 226 days.

(21) Appl. No.: 11/236,973

(22) Filed: Sep. 28, 2005

(65) Prior Publication Data

US 2007/0071550 A1 Mar. 29, 2007

(51) Int. Cl.
*E01C 7/35* (2006.01)

(52) U.S. Cl. ..... 404/75; 404/72; 404/81; 404/82

(58) Field of Classification Search ..... 404/75, 404/19, 20, 71, 72, 81, 82
See application file for complete search history.

(56) References Cited

U.S. PATENT DOCUMENTS 2,172,629 A * 9/1939 Treuhaft ..... 404/20
2,925,831 A * 2/1960 Welty et al. ..... 138/141
3,797,867 A * 3/1974 Hartl ..... 291/3
4,697,951 A * 10/1987 Allen ..... 404/110
4,748,788 A * 6/1988 Shaw et al. ..... 52/741.11
5,010,982 A * 4/1991 Sedlmayr ..... 188/4 B
5,234,128 A * 8/1993 Hill ..... 222/63
5,794,401 A * 8/1998 Shaw et al. ..... 52/741.41
6,016,635 A * 1/2000 Shaw et al. ..... 52/741.41
6,033,146 A * 3/2000 Shaw et al. ..... 404/20
2003/0140594 A1* 7/2003 Shaw et al. ..... 52/741.41
2003/0227814 A1* 12/2003 Priesnitz et al. ..... 366/2
2004/0041295 A1* 3/2004 Shaw et al. ..... 264/131
2004/0118025 A1* 6/2004 Shalit ..... 40/538

* cited by examiner

*Primary Examiner*—Thomas B. Will
*Assistant Examiner*—Alina Schiller
(74) *Attorney, Agent, or Firm*—Stetina Brunda Garred & Brucker

(57) ABSTRACT

A method and a surface seeded exposed aggregate concrete product are provided that precisely simulate the appearance and qualities of various types of natural quarried stone, such as granite, marble, rhinestone, bluestone, and brownstone, to name a few. Implementations of the present invention are characterized by the use of fine sand and aggregate broadcast over the exposed surface of poured concrete, which surface has been prepared to receive the same. Subsequently, a surface retarder and finishing steps are performed to produce the concrete product which assimilates the characteristics and colors of natural quarried stone, such as speckles, inclusions, flecks, graining, fractures, joints, knots, crystallization patterns, streaks, weathering, etc.

20 Claims, 2 Drawing Sheets

SURFACE SEEDED FINE AGGREGATE CONCRETE SIMULATING QUARRIED STONE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates generally to concrete products, and more particularly, to a method of producing simulated quarried stone by utilizing surface-seeded exposed aggregate concrete.

As is well known in the building and construction trade, concrete is extensively utilized as a building material for industrial, commercial and residential applications. Due to its durability, water resistance, and cost economy, concrete has gained wide spread use in flooring applications. With this wide spread use, the public is currently demanding variations in color, surface texture and overall appearance of concrete so that the concrete possesses improved aesthetics similar to more conventional and costly flooring surfaces such as marble, stone and granite.

In order to meet this demand, the concrete trade has developed various coloring and surface finishing techniques to enhance the aesthetics of concrete. Examples of such finishing techniques include salt finish, multiple broom finish, form press finish (e.g. stamped concrete), and exposed aggregate finish.

With particular regard to exposed aggregate finishes, one of two different production methods or techniques are typically utilized to form the same. The first is the "integrally exposed aggregate" method, which is the more conventional of the two techniques. The integrally exposed aggregate method entails washing or removing surface cement and fines from the concrete while the concrete surface is still plastic (i.e., prior to full curing) such that the aggregate (which is normally rock or gravel) is left exposed on the surface of the concrete. Due to the fact that the concrete aggregate is relatively large in size (i.e., approximately one-half inch to one inch in mean diameter), as well as the fact that the washing process is not uniform in nature, the resultant concrete surface produced via the integrally exposed aggregate method is often extremely rough and jagged. This characteristic limits wide spread use of the integrally exposed aggregate method in flooring applications. Further, the rough and jagged appearance also fails to create the aesthetic appearance of stone or marble that is desired.

The second method is the "surface seeded exposed" method, which has recently been introduced into the trade. In this particular method, subsequent to pouring the concrete, rock or gravel aggregate is scattered (i.e. broadcasted or seeded) over the top surface of the concrete and subsequently troweled into the same. As the concrete cures, the aggregate becomes adhered to the top surface of the concrete and is thus exposed. Although various sizes of aggregate can be broadcast over the top surface of the concrete in this method, such aggregate is normally of about three-eighths inch diameter or greater in size, and has sheared or jagged edges. The size and shape of the aggregate allows it to be worked into the top surface of the concrete and adequately adhered thereto. However, although the resultant concrete surface produced through the surface seeded exposed aggregate method is flatter than the surface produced through. the integrally exposed aggregate method, neither surface is free of irregularities, and both surfaces still posses an extremely rough surface finishes which limit their wide spread use in flooring applications. In particular, neither method produces a surface finish comparable to that of marble, stone, or granite.

In order to overcome the above-mentioned deficiencies of the prior art, methods have been developed to enhance the surface finish of concrete by reducing the size of the aggregate exposed on the surface of the concrete. However, as the aggregate decreases in size, other challenges develop due to the alkali-silica reaction (ASR). ASR is a chemical process through which alkalis from cement and silica from aggregate, combine to form a gel that expands in the presence of moisture and causes cracking in concrete and disrupts the adhesion of aggregate to the top surface of the concrete.

In response to the challenges that ASR presents, other methods have been developed to obtain sufficient surface flatness while substantially eliminating the effects of ASR. In particular, several of these methods are described in Applicant's U.S. Pat. Nos. 4,748,788, 6,016,635, and 6,033,146, the contents of which are incorporated herein by reference. Applicant's techniques as described in the above-mentioned patents overcame many of the deficiencies of the prior art and produced improved surface finishes on surface seeded exposed aggregate concrete. In particular, the concrete resultant from practice of the above-mentioned patents exhibits an extremely flat exposed aggregate surface suitable for extremely high traffic flooring applications. However, although the surface seeded exposed aggregate method has hitherto been refined to produce surfaces that assimilate more costly surfaces such as stone, marble, or granite, no process has been developed to model the fine, medium, and coarse grain textures of natural quarried stone.

Therefore, there is a need in the art for a surface seeded exposed aggregate method that produces surfaces which model the fine, medium, and coarse grain textures of natural quarried stone. Further, there is a need in the art for a surface seeded exposed aggregate method that incorporates flecks, speckles, and inclusions of natural quarried stone.

BRIEF SUMMARY

According to a preferred embodiment of the present invention, a method and a surface seeded exposed aggregate concrete product are provided that precisely simulate the appearance and qualities of various types of natural quarried stone, such as granite, marble, rhinestone, bluestone, and brownstone, to name a few. Implementations of the present invention include a concrete product that models the fine, medium, and/or coarse grain textures of natural quarried stone. Further implementations of the present invention include a concrete product that incorporates flecks, speckles, and inclusions of natural quarried stone. Thus, implementations of the present invention may provide a concrete product that precisely assimilates the characteristics and colors of natural quarried stone, such as black speckles, red and black garnet inclusions, quartz crystals, mica flecks, as well as the graining, fractures, joints, knots, crystallization patterns, sand seams, streaks, subjoints, weathering, and/or rock texture properties such as porphyritic, ophitic, and orei, which is common in natural quarried stone.

In an implementation of the present invention, a method of producing simulated quarried stone is provided which utilizes surface seeded exposed aggregate upon a subgrade. The method comprises the steps of: (a) pouring a concrete mixture over the subgrade, the concrete mixture defining an exposed surface when poured; (b) finishing the exposed surface of the concrete mixture to dispose a quantity of cement/fines paste derived from the concrete mixture at the exposed surface thereof; (c) broadcasting a quantity of fine sand upon the exposed surface of the concrete mixture; (d) broadcasting a quantity of aggregate upon the exposed surface of the concrete mixture; (e) mixing the fine sand and the aggregate into the cement/fines paste; (f) applying a surface retarder to the exposed surface; and (g) massaging the surface retarder into the exposed surface to produce the simulated quarried stone from the fine sand and the aggregate.

Other embodiments of the present invention may include additional modifications. For example, the fine sand and the aggregate may be applied pneumatically to be evenly spread upon the exposed surface. In addition, step (e) may include power troweling the fine sand and the aggregate into the cement/fines paste. The fine sand may be of a given color corresponding to the simulated quarried stone. The aggregate may also be of a given color corresponding to the simulated quarried stone. The method may further include the step of coordinating the color of the fine sand and the color of the aggregate to produce the simulated quarried stone. The method may also include the step of producing a pattern utilizing the fine sand to produce the simulated quarried stone.

In other embodiments of the present invention, the method may include the step of varying the size of the aggregate to produce the simulated quarried stone. Additionally, the method may include the step of varying the quantity per unit area of the aggregate to produce the simulated quarried stone. The method may also include the step of cutting the exposed surface corresponding to a surface design.

According to an aspect of the present invention, step (a) may further include mixing the concrete mixture with a color additive. Additionally, step (c) may further include mixing the fine sand into the quantity of cement/fines paste. The method may also further include the step of utilizing a vibrating bull float to dispose a quantity of cement/fines paste derived from the concrete mixture at the exposed surface thereof. Further, step (e) may further include utilizing a vibrating bull float to mix the fine sand and the aggregate into the quantity of cement/fines paste. Step (f) may further include massaging the surface retarder into the quantity of cement/fines paste having the fine sand and the aggregate mixed therein.

In accordance with yet another embodiment of the present invention, the aggregate has a mean diameter size of less than three-eights of one inch. In this regard, it is contemplated that the applying of the surface retarder may cause penetration of the surface retarder into the exposed surface of the concrete mixture through a distance greater than the mean diameter of the particulate.

Another implementation of the present invention may include the steps of: (a) washing surface films from the exposed surface; (b) curing the concrete mixture and the cement/fines paste to form a cured mixture and a cured paste; and (c) washing the exposed surface to remove surface residue therefrom. Further, the method may further include the step of altering the surface roughness of the exposed surface of the concrete mixture after curing the concrete mixture and cement/fines paste.

Additionally, another embodiment of the present invention includes a surface seeded exposed particulate concrete product formed by the various methods disclosed herein. As mentioned above, the concrete product is contemplated to exhibit superior qualities compared to products of the prior art. The methods and techniques disclosed herein are not believed to be disclosed, taught, or suggested in the prior art. Thus, the novel and nonobvious methods and products, which are disclosed herein, have provided an unequaled simulated quarried stone product which exhibits many of the properties of natural quarried stone, i.e., the graining, fractures, joints, knots, crystallization patterns, sand seams, streaks, subjoints, weathering, and/or rock texture properties such as porphyritic, ophitic, and orei, depending on the stone that is simulated.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
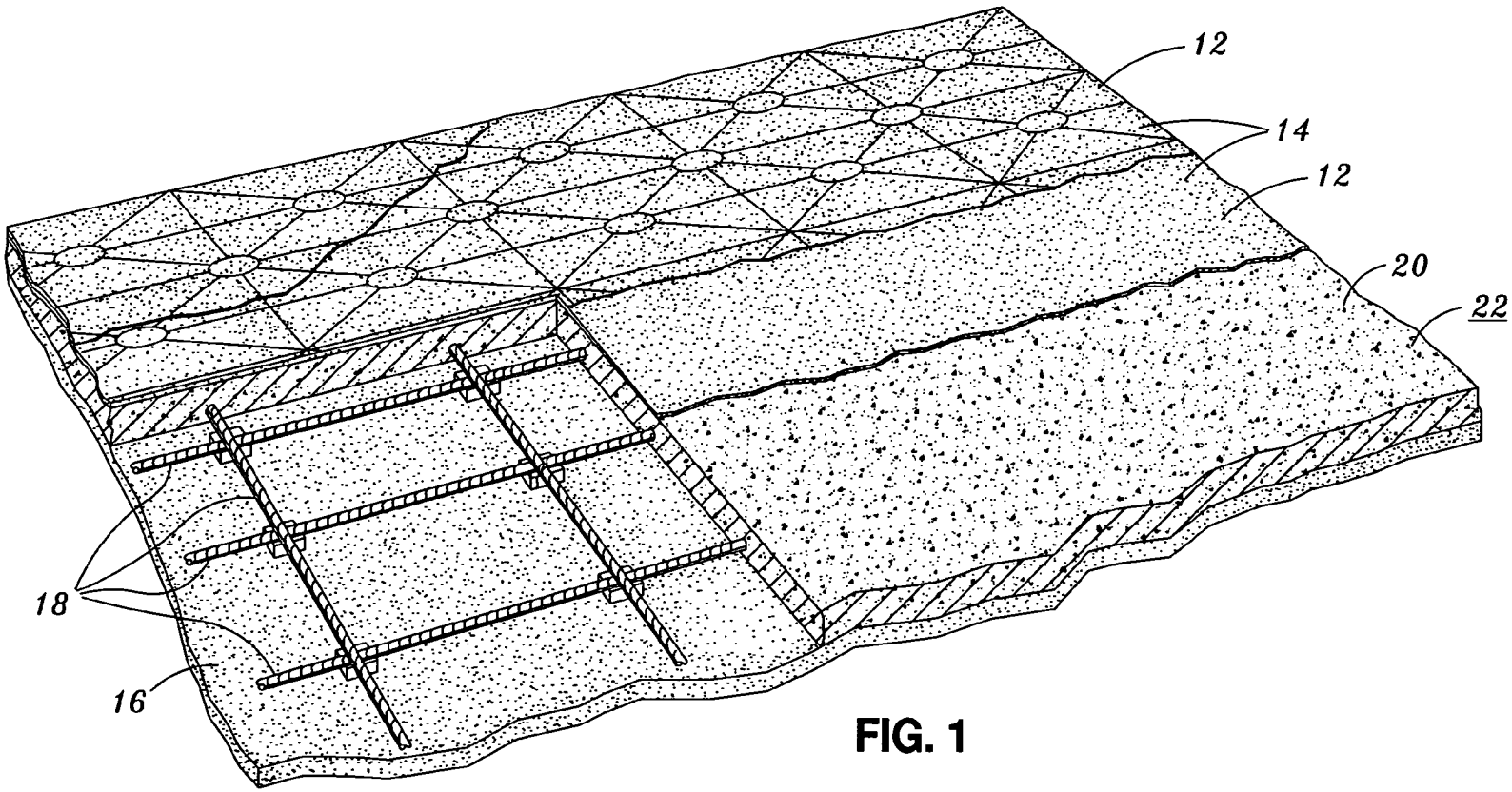
FIG. 1 is a perspective view illustrating stages of preparation of a surface seeded exposed aggregate concrete product produced in accordance with an embodiment of the present invention.
Figure 2:
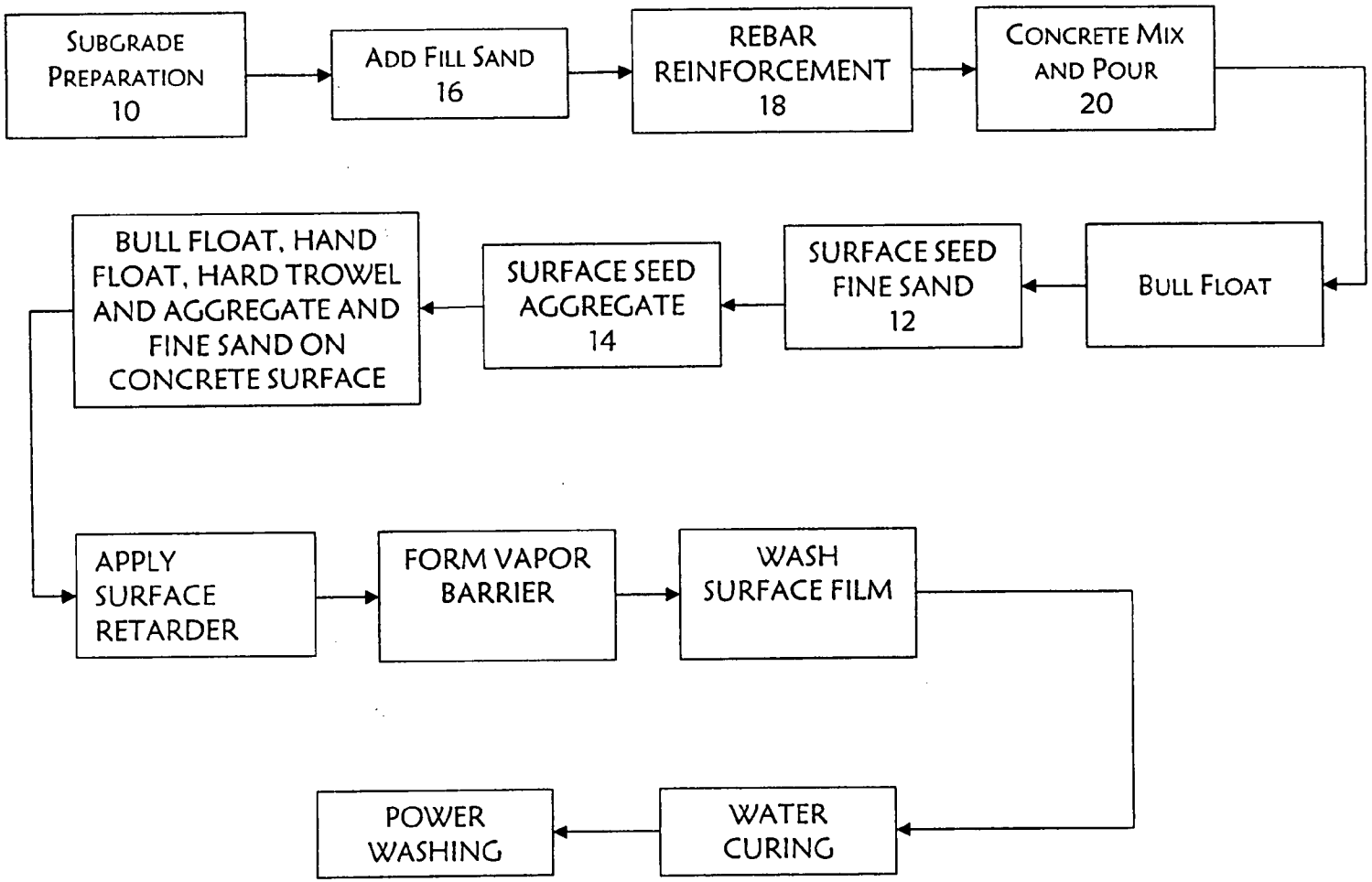
FIG. 2 is schematic diagram illustrating steps of a method for producing the concrete product in accordance with another embodiment of the present invention.

Referring now to the drawings wherein the showings are for purposes of illustrating the preferred embodiments of the invention only, and not for purposes of limiting the same, FIGS. 1-2 illustrate the simulated quarried stone and the method of producing the same. Preferred embodiments of the method utilize surface-seeded exposed aggregate upon a subgrade 10, similar to several of the above-mentioned prior art methods. However, the present method incorporates a novel and non-obvious method of producing simulated quarried stone.

In particular, implementations of the present invention have produced a simulated quarried stone that precisely models the fine, medium, and/or coarse grain textures of natural quarried stone as well as the flex, speckles, and inclusions that are also present in natural quarried stone. This method is believed to be novel and nonobvious over prior art methods because it incorporates novel aspects which are not believed to be known, taught, or suggested in the prior art. In part due to problems posed by ASR (alkali silica reaction), and also as an indication of the novelty of implementations of the present invention, those skilled in the art have not combined fine sand 12 and aggregate 14 to simulate quarried stone, as is taught herein. Indeed, given the knowledge of those skilled in the art, there has been no expectation that such a product could be successfully produced utilizing prior art methods. Finally, no detailed enabling methodology is provided in the prior art or in the knowledge of one skilled in the art.

In particular, the prior art does not teach combining various types of fine sand 12 and aggregate 14 to produce a finished surface, as taught below in implementations of the present invention. In this regard, implementations of the present invention incorporate elements and aspects that have been unknown and unpracticed in the art. Until recently, such method has been unknown to and unpracticed by skilled artisans in the field of concrete preparation.

Although certain prior art references may suggest that surface seeded exposed aggregate concrete may be formed to exhibit improved aesthetics resembling granite, stone, or marble, no detailed enabling method is provided or taught for achieving the result as produced by implementations of the present invention. Indeed, the prior art focuses principally on improving the flatness/surface finish of the concrete in order to provide exposed aggregate concrete suitable for high traffic applications. Therefore, the prior art falls short of teaching the various embodiments of the present invention disclosed below.

As may be appreciated by one of skill in the art, implementations of the present method also meet an unfilled need, which the prior art has failed to satisfy. Performance of implementations of the present invention create a textured surface that more precisely models natural quarried stone, including the specks, inclusions, and other natural features of real quarried stone. Although such a finish may have been sought previously, until the present time, no method has been presented that suggests a reasonable expectation of success in simulating the various aspects of natural quarried stone such as graining, fractures, joints, knots, crystallization patterns, sand seams, streaks, subjoints, weathering, and/or rock texture properties such as porphyritic, ophitic, and orei.

An implementation of the present invention may be performed after properly preparing the subgrade 10, which may be performed in a variety of ways, utilizing a variety of tools, materials, and methods. One such conventional mode of preparation, as shown in FIG. 2, the initial step in the method of the present invention, comprises the preparation of the subgrade 10 to a desired elevation and grade and to compact the same preferably to ninety percent (90%) compaction. Subsequent to this preparation, the subgrade 10 is covered with a layer of clean, moist fill sand 16 which is preferably maintained at a minimum four (4) inch layer thickness. Although the fill sand 16 is not absolutely necessary for the method of producing the simulated quarried stone of the present invention, it is highly desirable to control the hydration process of the concrete. In order to increase the resultant strength of the concrete and reduce subsequent cracking of the same, reinforcement members 18 such as a wire mesh or rebar is/are positioned upon the layer of fill sand 16. The layer which includes the fill sand 16 and the reinforcement members 18 is often referred to as the subgrade 10.

A concrete mixture 20 is poured over the subgrade 10 such that the reinforcement members 18 are encapsulated within the concrete mixture 20. The concrete mixture 20 is poured to approximately a three and one half (3½) to four (4) inch thickness. Although variations in the concrete mixture 20 are contemplated, a preferred concrete mixture 20 comprises seventy percent (70%) sand and thirty percent (30%) three-eighth (⅜) inch mean diameter aggregate combined with six sack cement (2,000 pounds per square inch) or seven sack cement (3,000 pounds per square inch). Dependent on individual tastes, various color mixtures can be added to the concrete mixture 20.

After the concrete mixture 20 has been poured, the concrete mixture 20 is preferably screeded to a desired level plane or grade. The screeding of the concrete mixture 20 results in the same defining a generally level or planer upper exposed surface 22. In the present invention, the concrete mixture 20 is not tamped as is conventional in the art. In this respect it has been determined that tamping should be avoided in implementing embodiments of the present invention so as not to bring up too much cement/fines in the concrete mixture 20 which would be prohibited for the subsequent surface seeding of the exposed aggregate thereupon. Rather, subsequent to screeding, the exposed surface 22 of the concrete mixture 20 is surfaced or finished to dispose a quantity of the cement/fine paste derived from the concrete mixture 20 at the exposed surface 22 thereof. This finishing may be done utilizing a vibrating bull float. The vibrating bull float is typically characterized by possessing an extremely smooth or polished surface which, in addition to bringing up the appropriate amount of cement/fine paste for the subsequent manipulative steps of the present invention, also tends to seal the exposed surface 22 of the concrete mixture 20. It is contemplated that this initial finishing step may be completed through the use of a vibrating metal bull float, such as a vibrating magnesium bull float or a vibrating aluminum bull float. A preferred metal bull float is sold under the trademark HAL200 by the Lievers Holland Co.

In preferred embodiments of the present invention, when the exposed surface 22 of the concrete mixture 20 is still plastic, fine sand 12 is broadcast over the exposed surface 22. The fine sand 12 may be of any given color or texture, as required to produce the simulated quarried stone. Further, it is contemplated that various combinations of color, texture, or other characteristics of the fine sand 12 may be variously created in order to accurately simulate quarried stone. Thus, in some instances, multiple types of fine sand 12 may be utilized in a given project to produce desired aesthetic effects. In other instances, the fine sand 12 may be of a single type. In this regard, the coloring and/or patterns created utilizing the fine sand 12 may be produced dependant upon the manner in which the fine sand 12 is broadcast upon the exposed surface 22. The fine sand 12 may be utilized to produce an overall shade or color as the simulated quarried stone, or may be alternated with other colors of the fine sand 12 or quantity thereof to simulate the various aspects of natural quarried stone such as graining, fractures, joints, knots, crystallization patterns, sand seams, streaks, subjoints, weathering, and/or rock texture properties such as porphyritic, ophitic, and orei.

In addition to the broadcasting of the fine sand 12, a quantity of aggregate 14 is also broadcast upon the exposed surface 22 of the concrete mixture 20. As mentioned above in relation to the fine sand 12, the characteristics of the aggregate 14, such as the color, texture, or size, may be varied as required in order to simulate natural quarried stone. Indeed, in order to simulate the flex, speckles, and inclusions of natural quarried stone, it is contemplated that the aggregate 14 may contrast the fine sand 12, or alternatively, that the aggregate 14 may be utilized to compliment the fine sand 12 and thereby simulate natural quarried stone. As is known by one of skill in the art, quarried stone may be of various types, such as granite, marble, rhinestone, bluestone, and brownstone, to name a few. It is contemplated that the aggregate 14 and fine sand 12 may be matched in various combinations of color, size, pattern, etc., to produce the various effects that natural quarried stone displays, such as graining, fractures, joints, knots, crystallization patterns, sand seams, streaks, subjoints, weathering, rock texture properties such as porphyritic, ophitic, and orei, etc. In addition, the quantity of the fine sand 12 and/or the aggregate 14 per unit area may also be varied to simulate natural quarried stone. Finally, it is contemplated that the exposed surface 22 may be cut corresponding to a surface design, as required to produce simulated quarried stone. In this regard, the cuts may be done according to the requirements of a given project, such as straight cuts, cuts of any geometry, or cuts to simulate the shape and texture of natural quarried stone.

According to an implementation of the present invention, it is contemplated that the broadcasting of the fine sand 12 and the aggregate 14 may be performed utilizing pneumatic equipment. In this regard, the pneumatic equipment may allow an operator to be more precis and even in the placement of the fine sand 12 and/or aggregate 14 during broadcasting. As mentioned, the use of pneumatic equipment may allow the fine sand 12 and/or the aggregate 14 to be evenly spread upon the exposed surface 22; however, it is also contemplated that the pneumatic equipment may allow the operator to produce a randomized pattern or a design corresponding to a particular natural quarried stone. Thus, the appearance of the exposed surface 22 may be enhanced utilizing other tools such as pneumatic equipment.

After being broadcast upon the exposed surface 22 of the concrete mixture 20, the fine sand 12 and the aggregate 14 are mixed or worked into the exposed surface 22 of the concrete mixture 20, and more particularly are mixed into the cement/fine paste of the exposed surface 22. In implementations of the present invention, this step may be utilized to further enhance the physical placement of the fine sand 12 and the aggregate 14 on the exposed surface 22. It is contemplated that this step may be variously performed in order to create various effects that natural quarried stone displays, such as graining, fractures, joints, knots, crystallization patterns, sand seams, streaks, subjoints, weathering, rock texture properties such as porphyritic, ophitic, and orei, etc. This may be accomplished utilizing a power trowel. However, it is contemplated that the mixing may be accomplished utilizing other devices known in the art. This mixing of the fine sand 12 and the aggregate 14 with the cement/fine paste at the exposed surface 22 is also critical to the process of the present invention because it ensures that the fine sand 12 and the aggregate 14 are fully embedded into the cement/fine paste and thus thoroughly adhered or bonded to the exposed surface 22 of the concrete mixture 20 upon resultant curing.

Referring now to FIG. 2, subsequent to the mixing of the fine sand 12 and the aggregate 14 into the cement/fine paste at the exposed surface 22 of the concrete mixture 20, the exposed surface 22 may be finished with a power trowel to properly level and finish the exposed surface 22. Thereafter, a chemical surface retarder may be sprayed upon the exposed surface 22 to uniformly cover the same. The chemical retarder slows down the hydration process of the concrete mixture 20. The application of the surface retarder to the exposed surface 22 may be followed by the step of finishing the exposed surface 22 of the concrete mixture 20 with the power trowel, for example, to massage the surface retarder into the cement/fine paste having the fine sand 12 and the aggregate 14 mixed therein. This finishing step preferably results in the penetration of the surface retarder into the cement/fine paste a distance below the maximum depth of the fine sand 12 and the aggregate 14, which may be at least approximately ⅜ inch in some instances. Advantageously, this particular finishing step may eliminate hard spots in the resulted concrete by facilitating a full mix of the retarder and the cement fine paste. The power trowel preferably used in relation to both this and the previously mentioned step finishes the exposed surface 22 of the concrete mixture 20 in a generally circular motion. Although various conventional surface retarders may be utilized, a superior surface retarder is designated as SPEC AE manufactured by E.L. Moor Co. of Costa Mesa, Calif.

Referring again to FIG. 2, subsequent to the surface retarder being massaged into the cement/fine paste, a vapor barrier may be preferably formed on the exposed surface 22 of the concrete mixture 20. In the preferred embodiment, the formation of the vapor barrier is facilitated by the application of a liquid chemical evaporation reducer to the exposed surface 22 of the concrete mixture 20. A preferred evaporation reducer is sold under the trademark CONFILM by the Concrete Tie Co. of Compton, Calif. An alternative vapor barrier may be formed by covering the exposed surface 22 with four (4) or six (6) millimeters of visquene. The vapor barrier is maintained upon the exposed surface 22 of the concrete mixture 20 for a prescribed period of time which may range from approximately two (2) to twenty-four (24) hours.

After the vapor barrier has remained upon the exposed surface 22 for a prescribed period of time, the exposed surface 22 of the concrete mixture 20 may be washed with water to remove any surface films therefrom. In this washing procedure, it may be preferable to lightly brush the exposed surface 22 with a bristle brush. This may be done according to design requirements in creating a simulated quarried stone appearance. The washing step, as described herein, may be done without excessive dislodgement and loss of the fine sand 12 or the aggregate 14 due to the full mixture of the retarder and cement/fine paste performed during the power troweling of the exposed surface 22. Additionally, the application of the liquid evaporation reducer to the exposed surface 22 may also reduce the rate of the evaporation of moisture from the exposed surface 22 and increase the ease at which the excess cement/fine paste and residual surface retarder are washed from the exposed surface 22.

As illustrated in FIG. 2, subsequent to washing, the concrete mixture 20 may be cured utilizing water alone, as opposed to chemical curing agents in order to avoid staining of the exposed surface 22. Such water curing may typically be facilitated through the use of a conventional fogger or soaker hose. After a prescribed period of time (e.g., 30 days after initiating the curing process) any surface residue present on the exposed surface 22 is removed by conventional power washing with a ninety percent (90%) steam and ten percent (10%) muriatic acid mixture which is applied by a power washer via a high pressure nozzle.

The resultant surface exhibits an appearance of natural quarried stone. Further, as an extremely flat surface seeded exposed aggregate surface, it is also suitable for high pedestrian traffic. As described above, various modifications in the color, size, texture, and other characteristics of the fine sand 12 and the aggregate 14 may be modified in order to produce numerous types of simulated quarried stone.

The above description is given by way of example, and not limitation. Given the above disclosure, one skilled in the art could devise variations that are within the scope of the invention disclosed herein, including various ways of creating different textures, colors, patterns, types of stone, etc. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. A method of producing simulated quarried stone by utilizing a combination of fine sand and surface seeded exposed aggregate upon a subgrade, the method comprising:

a. pouring a concrete mixture over the subgrade, the concrete mixture defining an exposed surface when poured;

b. finishing the exposed surface of the concrete mixture to dispose a quantity of cement/fines paste derived from the concrete mixture at the exposed surface thereof;

c. broadcasting a quantity of fine sand upon the exposed surface of the concrete mixture;

d. broadcasting a quantity of aggregate upon the exposed surface of the concrete mixture;

e. mixing the fine sand and the aggregate into the cement/fines paste;

f. applying a surface retarder to the exposed surface; and g. massaging the surface retarder into the exposed surface, the fine sand and aggregate mixture simulating characteristics of quarried stone when the exposed surface is cured.

2. The method of claim 1 wherein the fine sand and the aggregate are applied pneumatically to be evenly spread upon the exposed surface.

3. The method of claim 1 wherein step (e) includes power troweling the fine sand and the aggregate into the cement/fines paste.

4. The method of claim 1 wherein the fine sand is of a given color corresponding to the simulated quarried stone.

5. The method of claim 1 wherein the aggregate is of a given color corresponding to the simulated quarried stone.

6. The method of claim 1 further including the step of coordinating the color of the fine sand and the color of the aggregate to produce the simulated quarried stone.

7. The method of claim 1 further including the step of producing a pattern utilizing the fine sand to produce the simulated quarried stone.

8. The method of claim 1 further including the step of varying the size of the aggregate to produce the simulated quarried stone.

9. The method of claim 1 further including the step of varying the quantity per unit area of the aggregate to produce the simulated quarried stone.

10. The method of claim 1 further including the step of cutting the exposed surface corresponding to a surface design.

11. The method of claim 1 wherein step (a) further includes mixing the concrete mixture with a color additive.

12. The method of claim 1 wherein step (c) further includes mixing the fine sand into the quantity of cement/fines paste.

13. The method of claim 12 further includes utilizing a vibrating bull float to dispose a quantity of cement/fines paste derived from the concrete mixture at the exposed surface thereof.

14. The method of claim 1 wherein step (e) further includes utilizing a vibrating bull float to mix the fine sand and the aggregate into the quantity of cement/fines paste.

15. The method of claim 1 wherein step (f) further includes massaging the surface retarder into the quantity of cement/fines paste having the fine sand and the aggregate mixed therein.

16. The method of claim 1 wherein the aggregate has a mean diameter size of less than three-eights of one inch.

17. The method of claim 1 wherein said applying of the surface retarder causes penetration of the surface retarder into the exposed surface of the concrete mixture through a distance greater than the mean diameter of the particulate.

18. The method of claim 1 further including the steps of a. washing surface films from the exposed surface;

b. curing the concrete mixture and the cement/fines paste to form a cured mixture and a cured paste; and c. washing the exposed surface to remove surface residue therefrom.

19. The method of claim 18 further including the step of altering the surface roughness of the exposed surface of the concrete mixture after curing the concrete mixture and cement/fines paste.

20. A surface seeded exposed particulate concrete product formed by the method of claim 1.

* * * * *